US010883245B2

(12) United States Patent
Yumoto et al.

(10) Patent No.: US 10,883,245 B2
(45) Date of Patent: Jan. 5, 2021

(54) HYDRAULIC DRIVING APPARATUS OF WORK MACHINE

(71) Applicant: KOBELCO CONSTRUCTION MACHINERY CO., LTD., Hiroshima (JP)

(72) Inventors: Natsuki Yumoto, Hiroshima (JP); Koji Ueda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 16/446,972

(22) Filed: Jun. 20, 2019

(65) Prior Publication Data

US 2020/0011022 A1 Jan. 9, 2020

(30) Foreign Application Priority Data

Jul. 4, 2018 (JP) ..... 2018-127604

(51) Int. Cl.
*E02F 3/36* (2006.01)
*E02F 9/22* (2006.01)
*E02F 9/08* (2006.01)

(52) U.S. Cl.
CPC ..... *E02F 3/3663* (2013.01); *E02F 9/2292* (2013.01); *E02F 9/0858* (2013.01)

(58) Field of Classification Search
CPC ..... E02F 9/2239; E02F 9/2242
See application file for complete search history.

(56) References Cited

U.S. PATENT DOCUMENTS 3,922,855 A * 12/1975 Bridwell ..... B62D 11/183 60/421
5,970,709 A * 10/1999 Tohji ..... E02F 9/2242 60/421

(Continued)

FOREIGN PATENT DOCUMENTS

EP 2 980 325 A1 2/2016
JP 9-217385 8/1997

OTHER PUBLICATIONS

Extended European Search Report dated Dec. 9, 2019 in Patent Application No. 19181925.9, 8 pages.

*Primary Examiner* — Michael Leslie
*Assistant Examiner* — Matthew Wiblin
(74) *Attorney, Agent, or Firm* — Oblon, McClelland, Maier & Neustadt, L.L.P.

(57) ABSTRACT

Provided is a hydraulic driving apparatus capable of operating hydraulic actuators that actuate a boom, an arm, and a tip attachment at respective suitable speeds. The hydraulic driving apparatus includes a first hydraulic pump connected to a first main actuator, a second hydraulic pump connected to a second main actuator and an attachment actuator, a first merging selector valve that allows hydraulic fluid to be supplied from the first hydraulic pump to the second main actuator, and a power distribution control device that operates displacement of the first and second hydraulic pumps so as to decrease power distribution from a pump drive source to the second hydraulic pump and increase power distribution from the pump drive source to the first hydraulic pump when a specified combined operational action is performed on the second main actuator and the attachment actuator.

7 Claims, 10 Drawing Sheets

(56) References Cited

U.S. PATENT DOCUMENTS

| | | | | |
|---|---|---|---|---|
| 7,275,369 | B2 * | 10/2007 | Kim | E02F 9/2282 60/422 |
| 7,499,783 | B2 * | 3/2009 | Oka | E02F 9/2242 60/421 |
| 9,051,712 | B2 * | 6/2015 | Kodaka | E02F 3/962 |
| 2016/0017898 | A1 | 1/2016 | Kanenawa et al. | |
| 2016/0177539 | A1 * | 6/2016 | Hiraku | F15B 11/17 60/428 |
| 2018/0058041 | A1 | 3/2018 | Kamoshita et al. | |
| 2018/0073525 | A1 * | 3/2018 | Udagawa | E02F 9/2235 |
| 2019/0218751 | A1 * | 7/2019 | Kim | F15B 13/02 |

* cited by examiner

HYDRAULIC DRIVING APPARATUS OF WORK MACHINE

TECHNICAL FIELD

The present invention relates to an apparatus provided in a work machine including a working device to hydraulically drive the working device, the working device including a boom, an arm, and a tip attachment, the apparatus being designed.

BACKGROUND ART

There is known a working device to be mounted in a work machine, the working device having a boom capable of being raised and lowered, an arm rotatably connected to a distal end of the boom, and a tip attachment attached to a tip of the arm. Examples of the tip attachment include a grinder, a fork, and a breaker.

As an apparatus to hydraulically drive such a working device as described above, conventionally known is one described in FIG. 2 of Japanese Patent Application Laid-Open Publication H09-217385, which will be referred to as "Patent Document 1". The apparatus includes first and second hydraulic pumps each being a variable displacement one, a plurality of actuators connected to the first hydraulic pump, and a plurality of actuators connected to the second hydraulic pump. The plurality of actuators connected to the second hydraulic pump include an arm actuator for driving an arm (arm cylinder in Patent Document 1) and an attachment actuator for driving a tip attachment ("reserve actuator" in Patent Document 1).

In this apparatus, hydraulic fluid discharged from the first hydraulic pump is distributed to the arm actuator and the attachment actuator, while involving a possibility of unbalance of flow rate distribution. Specifically, when a combined motion is performed in which an arm pushing motion (that is, a motion of raising the tip attachment) and a motion of the tip attachment are simultaneously made, the load pressure of the arm actuator becomes significantly larger than load pressure of the attachment actuator, in particular, in the case where the tip attachment is heavy; therefore, if no measure is taken, the flow rate distribution of the hydraulic fluid discharged from the first hydraulic pump will be largely biased to the attachment actuator. This significantly delays the arm pushing motion with respect to the motion of the tip attachment, involving a decrease in work efficiency. This disadvantage may also occur when a boom actuator for driving a boom is connected to a common hydraulic pump, instead of the arm actuator, together with the attachment actuator.

As the measure, Patent Document 1 discloses performing interposing a pilot-operated variable throttle valve between the second hydraulic pump and the attachment actuator; inputting a pilot pressure for operating the arm into the variable throttle valve; and reducing the pilot pressure through a pressure reducing valve in accordance with the load pressure of the arm actuator, and thereby restricting the flow rate of the hydraulic fluid supplied to the attachment actuator to a degree according to the load pressure of the arm cylinder.

The apparatus described in Patent Document 1, thus, requires a dedicated variable throttle valve for restricting the flow rate of hydraulic fluid to be supplied to the attachment actuator. This involves an increase in complexity and costs of the apparatus. Besides, the restriction of the hydraulic fluid flow rate through the variable throttle valve involves significant pressure loss, thereby causing energy loss.

SUMMARY OF INVENTION

An object of the present invention is to provide a hydraulic driving apparatus for hydraulically driving a working device of a work machine, the hydraulic driving apparatus including an arm actuator, a boom actuator and an attachment actuator for driving a tip attachment, either the boom actuator or the arm actuator and the attachment actuator being connected to a common hydraulic pump, the apparatus being capable of actuating each of the actuators at a preferred speed.

To achieve the above object, what is focused on is a hydraulic pump that is not connected to the tip attachment. Specifically, merging a part of hydraulic fluid discharged by a first hydraulic pump, which is a hydraulic pump not connected to the attachment actuator out of the two hydraulic pumps, with hydraulic fluid supplied from a second hydraulic pump, which is the other hydraulic pump, to one of the boom actuator and the arm actuator, and biasing torque distribution of the first and second hydraulic pumps to the first hydraulic pump (that is, suppressing the distribution torque to the second hydraulic pump) make it possible to apply high torque to the first hydraulic pump to supply the hydraulic fluid to drive both the boom actuator and the arm actuator at a sufficient flow rate, and to restrict the torque of the second hydraulic pump to thereby restrict the flow rate of the hydraulic fluid supplied from the second hydraulic pump to the attachment actuator (without using a variable throttle valve).

Provided is a hydraulic driving apparatus provided in a work machine including a working device to hydraulically drive the working device, the working device including a boom that is capable of being raised and lowered, an arm connected to a tip of the boom so as to be capable of rotational movement, and a tip attachment attached to a distal end of the arm. The hydraulic driving apparatus includes: a boom actuator configured to receive supply of hydraulic fluid to thereby raise and lower the boom; an arm actuator configured to receive supply of hydraulic fluid to thereby bring the arm into rotational movement; an attachment actuator configured to receive supply of hydraulic fluid to thereby actuate the tip attachment; a pump power source configured to generate power; a first hydraulic pump that is a variable displacement pump to be connected to a first main actuator that is selected from the boom actuator and the arm actuator, the first hydraulic pump being configured to be operated by the power provided from the pump drive source so as to discharge hydraulic fluid to supply the hydraulic fluid to the first main actuator; a second hydraulic pump that is a variable displacement pump connected to a second main actuator and the attachment actuator, the second main actuator being one of the boom actuator and the arm actuator and different from the first main actuator, the second hydraulic pump being configured to be operated by the power provided from the pump drive source so as to discharge hydraulic fluid to supply the hydraulic fluid to the second main actuator and the attachment actuator; a first main control valve interposed between the first hydraulic pump and the first main actuator, the first main control valve being operable to change a flow rate of hydraulic fluid supplied from the first hydraulic pump to the first main actuator; a second main control valve interposed between the second hydraulic pump and the second main actuator, the second main control valve being operable to change a flow rate of hydraulic fluid supplied from the second hydraulic pump to the second main actuator; an attachment control valve interposed between the second hydraulic pump and the attachment actuator, the attachment control valve being operable to change a flow rate of hydraulic fluid supplied from the second hydraulic pump to the attachment actuator; a first main operation device configured to receive a first main operation for moving the first main actuator and to operate the first main control valve in accordance with the first main operation; a second main operation device configured to receive a second main operation for moving the second main actuator and to operate the second main control valve in accordance with the second main operation; an attachment operation device configured to receive an attachment operation for moving the attachment actuator and to operate the attachment control valve in accordance with the attachment operation; a first merging selector valve provided between the first hydraulic pump and the second main actuator, the first merging selector valve being configured to be opened, on condition that the second main operation for operating the second main actuator at least in a raising direction is applied to the second main operation device, to allow hydraulic fluid discharged from the first hydraulic pump to merge with hydraulic fluid discharged from the second hydraulic pump to be supplied to the second main actuator; and a power distribution control device configured to operate first pump displacement that is displacement of the first hydraulic pump and second pump displacement that is displacement of the second hydraulic pump to thereby control distribution of the power provided from the pump power source to the first hydraulic pump and the second hydraulic pump. The power distribution control device is configured to operate the first pump displacement and the second pump displacement so as to make the distribution of the power from the pump drive source to the second hydraulic pump be smaller and to make the distribution of the power from the pump drive source to the first hydraulic pump be larger when a specified combined operational action is performed on the second main operation device and the attachment operation device than when a second main single operational action is performed on the second main operation device. The specified combined operational action is an action of applying the second main operation for operating the second main actuator in the raising direction to the second main operation device to thereby open the first merging selector valve while simultaneously applying the attachment operation to the attachment operation device. The second main single operational action is an action of applying the second main operation to the second main operation device while not applying the attachment operation to the attachment operation device.

DESCRIPTION OF EMBODIMENT

There will be described a preferred embodiment of the present invention with reference to the drawings.

Figure 2:
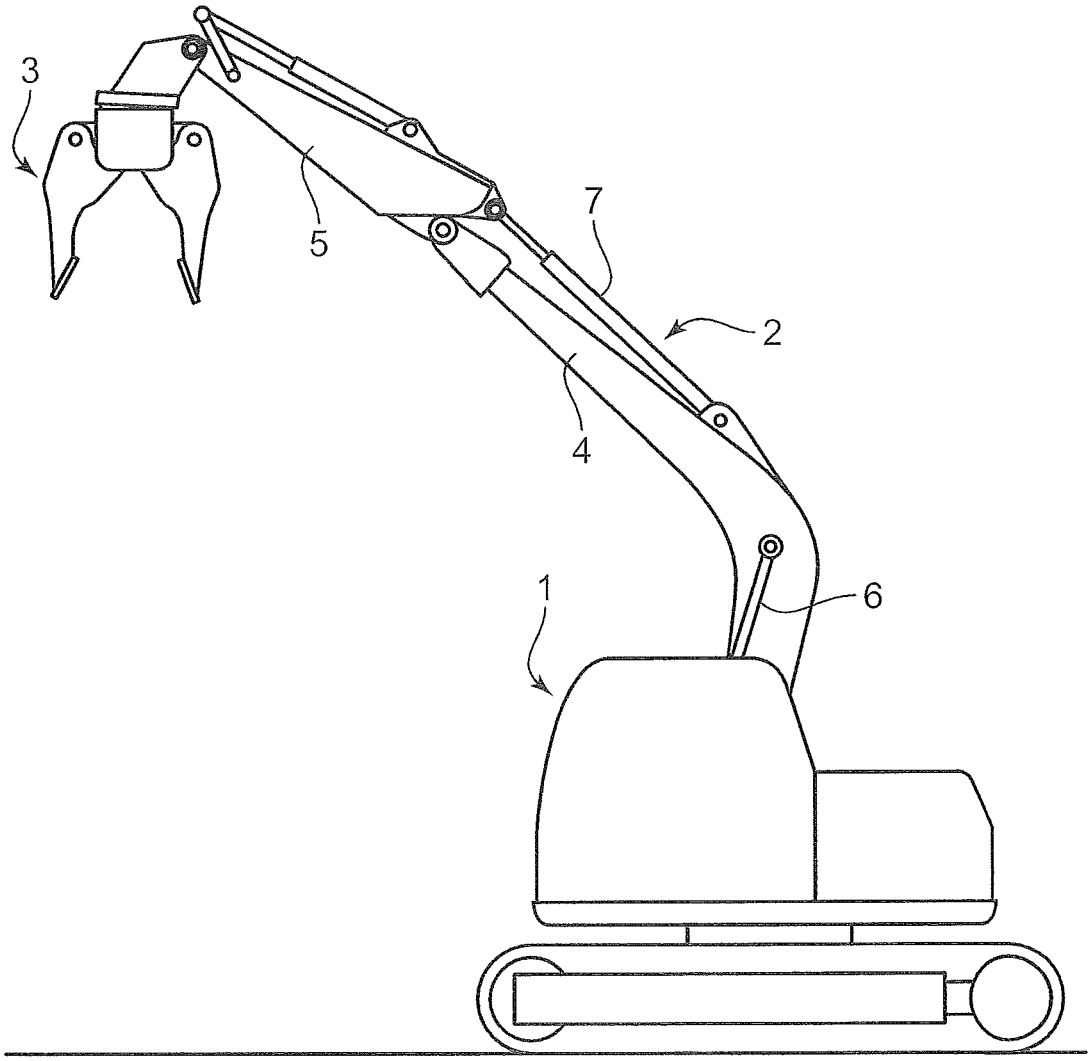
FIG. 2 is a front view showing an example of a work machine on which the hydraulic driving apparatus is installed.

FIG. 2 shows an example of a work machine on which a hydraulic driving apparatus according to the embodiment of the present invention is installed. This work machine is configured by use of an existing hydraulic excavator as a base, including a base machine 1 and a working device 2 mounted on the base machine 1. The working device 2 includes a boom 4 attached to the base machine 1 so as to be raisable and lowerable, an arm 5 including a proximal end rotatably connected to a tip of the boom 4 and a distal end on an opposite side thereof, and a tip attachment 3 to be detachably attached to the distal end of the arm 5. The tip attachment 3 shown in FIG. 2 is an opening and closing type crusher having a pair of openable and closable crush blades, configured to perform crush processing of an object through respective movements of the pair of crush blades in an opening and closing direction.

The work machine further includes a boom cylinder 6 and an arm cylinder 7. The boom cylinder 6 is a hydraulic cylinder interposed between the base machine 1 and the boom 4. The boom cylinder 6 is a boom actuator that receives supply of hydraulic pressure to be expanded and contracted to thereby bring the boom 4 into rotational movement in a rising direction, namely, a boom raising direction, and an opposite falling direction, namely, a boom lowering direction. The arm cylinder 7 is a hydraulic cylinder interposed between the boom 4 and the arm 5. The arm cylinder 7 is an arm actuator connected to the arm 5 so as to bring the arm into rotational movement in a retracting direction (direction in which the arm 5 approaches the boom 4, i.e., a direction to mainly lower the arm 5) and a pushing direction (direction in which the arm 5 becomes distant from the boom 4, i.e., in a direction to mainly raise the arm 5) by receiving supply of hydraulic pressure to be expanded and contracted.

Figure 1:
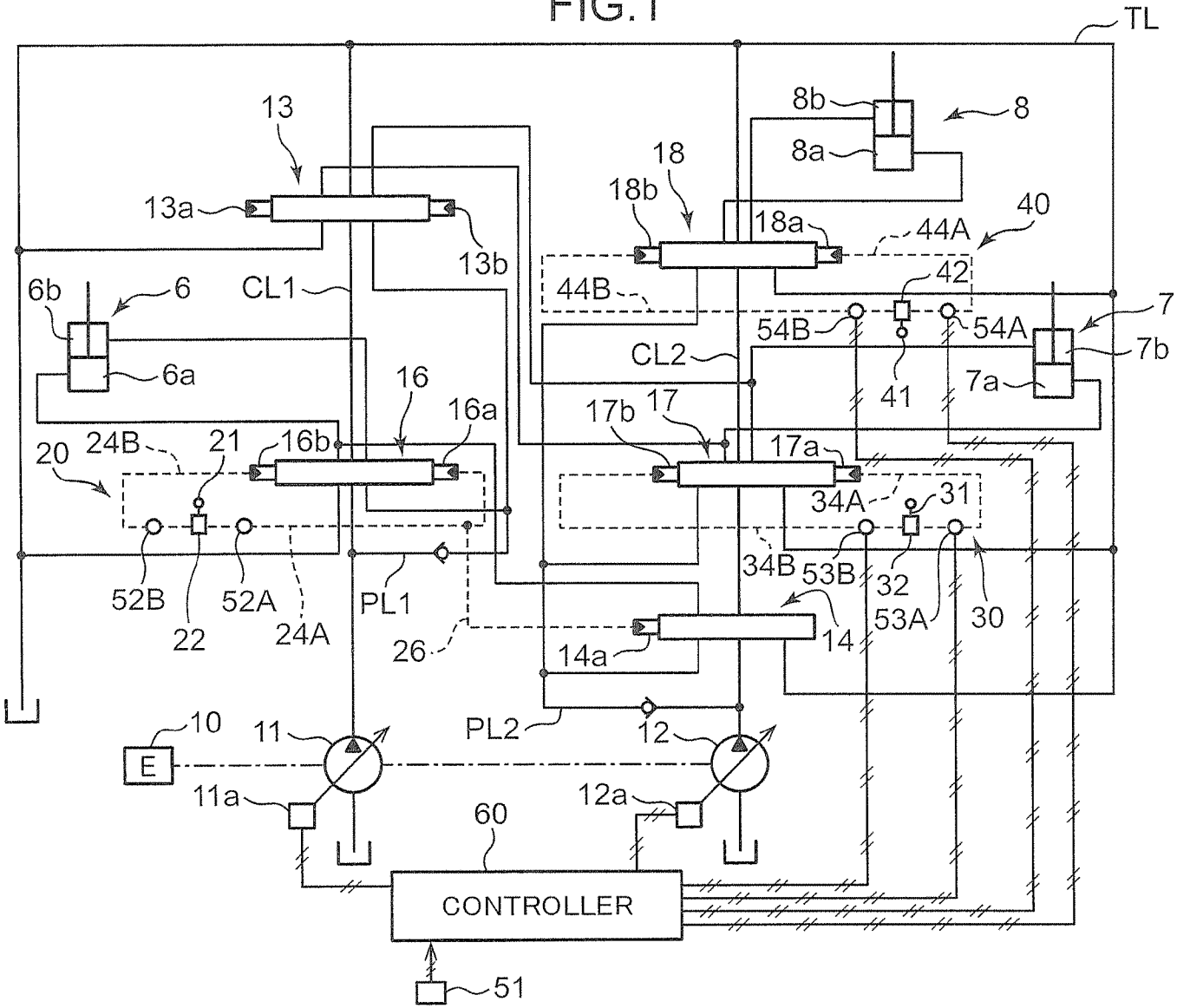
FIG. 1 is a circuit diagram showing a hydraulic driving apparatus according to a preferred embodiment of the present invention.

FIG. 1 is a diagram showing a hydraulic driving apparatus for hydraulically driving the working device 2. This hydraulic driving apparatus includes a plurality of hydraulic actuators. The plurality of hydraulic actuators includes, in addition to the boom cylinder 6 and the arm cylinder 7, a not-graphically shown travelling motor and an attachment cylinder 8, which is an attachment actuator for actuating the tip attachment 3. The attachment cylinder 8 in this embodiment is a hydraulic cylinder for opening and closing, being connected to the crush blades so as to open and close the pair of crush blades of the opening and closing crusher that correspond to the tip attachment 3. The attachment cylinder 8 is connected to a hydraulic circuit constituting the hydraulic driving apparatus shown in FIG. 1 when the tip attachment 3 is attached to the distal end of the arm 5.

The hydraulic driving apparatus shown in FIG. 1 includes: an engine 10; a first hydraulic pump 11; a second hydraulic pump 12; a plurality of control valves including a boom control valve 16, an arm control valve 17, and an attachment control valve 18; a boom operation device 20; an arm operation device 30; an attachment operation device 40; a first merging selector valve 13; and a second merging selector valve 14.

The engine 10 is a pump drive source that generates power and supplies the power to each of the first and second hydraulic pumps 11 and 12. The first and second hydraulic pumps 11 and 12 is operated by supply of power from the engine 10 to discharge hydraulic fluid, supplying the hydraulic fluid to at least a part of the plurality of hydraulic actuators, that is, the hydraulic actuators connected to the first and second hydraulic pumps 11 and 12.

Each of the first and second hydraulic pumps 11 and 12 is formed of a variable displacement hydraulic pump. The first and second hydraulic pumps 11 and 12 include respective regulators 11*a* and 12*a*, into which respective displacement command signals are inputted to operate (adjust) first pump displacement and second pump displacement of the first and second hydraulic pumps 11 and 12. The operation of the first and second pump displacements makes it possible to control distribution of power from the engine 10 to the first and second hydraulic pumps 11 and 12.

The first hydraulic pump 11 has a first discharge port, which is connected to an upstream end of a first center bypass line CL1. The second hydraulic pump 12 has a second discharge port, which is connected to an upstream end of a second center bypass line CL2. The first and second center bypass lines CL1 and CL2 also have respective downstream ends, which are communicated with a tank through a tank line TL.

In this embodiment, the boom control valve 16 and the first merging selector valve 13 are disposed sequentially from an upstream side along the first center bypass line CL1, the boom control valve 16 allowing the boom cylinder 6 to be connected to the first hydraulic pump 11 through the boom control valve 16. Besides, the second merging selector valve 14, the arm control valve 17, and the attachment control valve 18 are disposed sequentially from an upstream side along the second center bypass line CL2, the arm control valve 17 and the attachment control valve 18 allowing the arm cylinder 7 and the attachment cylinder 8 to be connected to the second hydraulic pump 12 through the arm control valve 17 and the attachment control valve 18, respectively.

Thus, in this embodiment, the boom cylinder 6 corresponds to a "first main actuator", and the boom control valve 16 corresponds to a "first main control valve" interposed between the "first main actuator" and the first hydraulic pump 11. Similarly, the arm cylinder 7 corresponds to a "second main actuator", and the arm control valve 17 corresponds to a "second main control valve" interposed between the "second main actuator" and the second hydraulic pump 12. However, it is also possible that the "first main actuator" be the arm cylinder 7 and the "second main actuator" be the boom cylinder 6. In other word, the arm cylinder 7 may be connected to the first hydraulic pump 11, and the boom cylinder 6 may be connected to the second hydraulic pump 12.

The circuit shown in FIG. 1 includes a first parallel line PL1 and a second parallel line PL2. The first parallel line PL1 is disposed so as to allow the hydraulic fluid discharged from the first hydraulic pump 11 to be supplied to the boom control valve 16 and the first merging selector valve 13 in parallel through the first parallel line PL1. The second parallel line PL2 is disposed so as to allow the hydraulic fluid discharged by the second hydraulic pump 12 to be supplied, in parallel, to the second merging selector valve 14, the arm control valve 17, and the attachment control valve 18 through the second parallel line PL2. The first parallel line PL1 is branched off from the first center bypass line CL1 at a position upstream of the first center bypass line CL1, further branched off on a downstream side thereof to reach the boom control valve 16 and the first merging selector valve 13. Similarly, the second parallel line PL2 is branched off from the second center bypass line CL2 at a position upstream of the second center bypass line CL2, further branched off on a downstream side thereof to reach the second merging selector valve 14, the arm control valve 17, and the attachment control valve 18.

Each of the boom control valve 16, the arm control valve 17, and the attachment control valve 18 is formed of a pilot-operated three-position direction selector valve having a flow rate control function, configured to be opened by input of a pilot pressure thereto.

The boom control valve 16 includes a boom raising pilot port 16*a* and a boom lowering pilot port 16*b* opposite thereto. The boom control valve 16 is held at a neutral position (that is, closed) when no pilot pressure is input into either of the pilot ports 16*a* and 16*b*, cutting off the boom cylinder 6 from the first hydraulic pump 11 and the tank. When a boom raising pilot pressure Pba is input into the boom raising pilot port 16*a*, the boom control valve 16 is shifted from the neutral position to a boom raising position (that is, opened) by a stroke corresponding to the magnitude of the boom raising pilot pressure Pba, forming a fluid path that allows hydraulic fluid discharged from the first hydraulic pump 11 to be supplied to a head side chamber 6*a* of the boom cylinder 6 at a flow rate corresponding to the stroke through the first parallel line PL1 and allows hydraulic fluid discharged from a rod side chamber 6*b* of the boom cylinder 6 to be returned to the tank through the tank line TL. In summary, the boom control valve 16 allows the boom cylinder 6 to be expanded at a speed corresponding to the boom raising pilot pressure Pba to thereby actuate the boom 4 at the speed in the raising direction. Conversely, when a boom lowering pilot pressure Pbb is input into the boom lowering pilot port 16*b*, the boom control valve 16 is shifted from the neutral position to a boom lowering position (that is, opened) by a stroke corresponding to the magnitude of the boom lowering pilot pressure Pbb, forming a fluid path that allows the hydraulic fluid discharged from the first hydraulic pump 11 to be supplied to the rod side chamber 6*b* of the boom cylinder 6 at a flow rate corresponding to the stroke through the first parallel line PL1 and allows the hydraulic fluid discharged from the head side chamber 6*a* of the boom cylinder 6 to be returned to the tank through the tank line TL. In summary, the boom control valve 16 allows the boom cylinder 6 to be contracted at a speed corresponding to the boom lowering pilot pressure Pbb to thereby actuate the boom 4 at the speed in a lowering direction.

The arm control valve 17 includes an arm retracting pilot port 17*a* and an arm pushing pilot port 17*b* opposite thereto. The arm control valve 17 is held at a neutral position (that is, closed) when no pilot pressure is input into either of the pilot ports 17*a* and 17*b*, cutting off the arm cylinder 7 from the second hydraulic pump 12 and the tank. When an arm retracting pilot pressure Paa is input into the arm retracting pilot port 17*a*, the arm control valve 17 is shifted from the neutral position to an arm retracting position (that is, opened) by a stroke corresponding to the magnitude of the arm retracting pilot pressure Paa, forming a fluid path that allows the hydraulic fluid discharged from the second hydraulic pump 12 to be supplied to a head side chamber 7*a* of the arm cylinder 7 at a flow rate corresponding to the stroke through the second parallel line PL2 and allows the hydraulic fluid discharged from a rod side chamber 7*b* of the arm cylinder 7 to be returned to the tank through the tank line TL. In summary, the arm control valve 17 allows the arm cylinder 7 to be expanded at a speed corresponding to the arm retracting pilot pressure Paa to thereby actuate the arm 5 at the speed in the retracting direction (generally, in a lowering direction). Conversely, when an arm pushing pilot pressure Pab is input into the arm pushing pilot port 17*b*, the arm control valve 17 is shifted from the neutral position to an arm pushing position (opened) by a stroke corresponding to magnitude of the arm pushing pilot pressure Pab, forming a fluid path that allows the hydraulic fluid discharged from the second hydraulic pump 12 to be supplied to the rod side chamber 7*b* of the arm cylinder 7 at a flow rate corresponding to the stroke through the second parallel line PL2 and allows the hydraulic fluid discharged from the head side chamber 7*a* of the arm cylinder 7 to be returned to the tank through the tank line TL. In summary, the arm control valve 17 allows the arm cylinder 7 to be contracted at a speed corresponding to the arm pushing pilot pressure Pab to thereby actuate the arm 5 at the speed in a pushing direction (generally, in a raising direction).

The attachment control valve 18 includes an expansion pilot port 18*a* and a contraction pilot port 18*b* opposite thereto. When no pilot pressure is input into either of the pilot ports 18*a* and 18*b*, the attachment control valve 18 is held at a neutral position (that is, closed) to cut off the attachment cylinder 8 from the second hydraulic pump 12 and the tank. When an expanding pilot pressure is input into the expansion pilot port 18*a*, the attachment control valve 18 is shifted from the neutral position to an expanding drive position (that is, opened) by a stroke corresponding to the magnitude of the expanding pilot pressure, forming a fluid path that allows the hydraulic fluid discharged from the second hydraulic pump 12 to be supplied to a head side chamber 8*a* of the attachment cylinder 8 at a flow rate corresponding to the stroke through the second parallel line PL2 and allows the hydraulic fluid discharged from a rod side chamber 8*b* of the attachment cylinder 8 to be returned to the tank through the tank line TL. In summary, the attachment control valve 18 allows the attachment cylinder 8 to be expanded at a speed corresponding to the expanding pilot pressure. Conversely, when a contracting pilot pressure is input into the contraction pilot port 18*b*, the attachment control valve 18 is shifted from the neutral position to a contracting drive position (opened) by a stroke corresponding to the magnitude of the contracting pilot pressure, forming a fluid path that allows the hydraulic fluid discharged from the second hydraulic pump 12 to be supplied to the rod side chamber 8*b* of the attachment cylinder 8 at a flow rate corresponding to the stroke through the second parallel line PL2 and allows the hydraulic fluid discharged from the head side chamber 8*a* of the attachment cylinder 8 to be returned to the tank through the tank line TL. In summary, the attachment control valve 18 allows the attachment cylinder 8 to be contracted at a speed corresponding to the contracting pilot pressure.

The first merging selector valve 13 is formed of a pilot-operated three-position direction selector valve including an arm retracting merging pilot port 13*a* and an arm pushing merging pilot port 13*b* opposite thereto. The first merging selector valve 13 is interposed between the first hydraulic pump 11 and the arm cylinder 7. When no pilot pressure is input into either of the pilot ports 13*a* and 13*b*, the first merging selector valve 13 is held at a neutral position (that is, closed) to open the first center bypass line CL1 and to cut off supply of the hydraulic fluid from the first hydraulic pump 11 to the arm cylinder 7. When a pilot pressure with a certain magnitude or more is supplied to the arm retracting merging pilot port 13*a*, the first merging selector valve 13 is shifted from the neutral position to an arm retracting merging position (that is, opened), allowing hydraulic fluid discharged from the first hydraulic pump 11 to the first parallel line PL1 to merge with hydraulic fluid supplied from the second hydraulic pump 12 to the head side chamber 7*a* of the arm cylinder 7. In summary, the first merging selector valve 13 allows the arm cylinder 7 to receive the supply of the hydraulic fluid discharged from the first hydraulic pump 11 in addition to the hydraulic fluid discharged from the second hydraulic pump 12 to be thereby accelerated in an expansion direction. Conversely, when a pilot pressure with a certain magnitude or more is input into the arm pushing merging pilot port 13*b*, the first merging selector valve 13 is shifted from the neutral position to an arm pushing merging position (opened), allowing hydraulic fluid discharged from the first hydraulic pump 11 to the first parallel line PL1 to merge with the hydraulic fluid supplied from the second hydraulic pump 12 to the rod side chamber 7*b* of the arm cylinder 7. In summary, the first merging selector valve 13 allows the arm cylinder 7 to receive the supply of the hydraulic fluid discharged from the first hydraulic pump 11 in addition to the hydraulic fluid discharged from the second hydraulic pump 12 to be thereby accelerated in a contraction direction.

The second merging selector valve 14 is formed of a pilot-operated two-position direction selector valve having a boom raising merging pilot port 14*a*, being interposed between the second hydraulic pump 12 and the boom cylinder 6. When no pilot pressure is input into the boom raising merging pilot port 14*a*, the second merging selector valve 14 is held at a neutral position (that is, closed) to open the second center bypass line CL2 and to cut off supply of the hydraulic fluid from the second hydraulic pump 12 to the boom cylinder 6. When a pilot pressure with a certain magnitude or more is supplied to the boom raising merging pilot port 14*a*, the second merging selector valve 14 is shifted from the neutral position to a boom raising merging position (opened), allowing hydraulic fluid discharged from the second hydraulic pump 12 to the second parallel line PL2 to merge with the hydraulic fluid supplied from the first hydraulic pump 11 to the head side chamber 6*a* of the boom cylinder 6. In summary, the second merging selector valve 14 allows the boom cylinder 6 to receive the supply of the hydraulic fluid discharged from the second hydraulic pump 12 in addition to the hydraulic fluid discharged from the first hydraulic pump 11 to be thereby accelerated in an expansion direction.

The boom operation device 20 receives a boom operation by an operator and causes the boom control valve 16 and further the second merging selector valve 14 to be opened in accordance with the boom operation, thus corresponding to a "first main operation device" according to the present invention. The boom operation device 20 includes a boom operation lever 21, a boom pilot valve 22, a boom raising pilot line 24A, a boom lowering pilot line 24B, and a boom raising merging pilot line 26.

The boom operation lever 21 is an operation member that receives the boom operation from the operator, the boom operation being a rotational movement operation for moving the boom cylinder 6, namely, a first main operation for moving the first main actuator. Specifically, the boom operation lever 21 is connected to the boom pilot valve 22 so as to be capable of rotational movement and allowed to be operated by the operator on both sides of the neutral position, that is, allowed to receive both a boom raising operation and a boom lowering operation. Each of the boom raising operation and the boom lowering operation is a boom operation corresponding to the "first main operation." The boom raising operation is an operation for expanding the boom cylinder 6 to displace the tip attachment 3 in a raising direction, that is, a direction including an upward component, against the gravity acting on the tip attachment 3.

The boom pilot valve 22 is opened to allow the pilot pressure to be supplied from a pilot hydraulic source to the boom control valve 16 and the second merging selector valve 14 in accordance with the boom operation applied to the boom operation lever 21. Specifically, the boom pilot valve 22 is connected to the boom raising pilot port 16*a* and the boom lowering pilot port 16*b* of the boom control valve 16 through the boom raising pilot line 24A and the boom lowering pilot line 24B, respectively. The boom pilot valve 22 is further connected to the boom raising merging pilot port 14*a* of the second merging selector valve 14 through the boom raising merging pilot line 26 branched off from the boom raising pilot line 24A.

The boom pilot valve 22 cuts off the supply of the pilot pressure when the boom operation lever 21 is at a neutral position. With application of the boom raising operation to the boom operation lever 21, the boom pilot valve 22 is opened to allow the boom raising pilot pressure Pba having magnitude corresponding to the amount of the operation to be supplied through the boom raising pilot line 24A and further the boom raising merging pilot line 26 to the boom raising pilot port 16*a* of the boom control valve 16 and further the boom raising merging pilot port 14*a* of the second merging selector valve 14. With application of the boom lowering operation to the boom operation lever 21, the boom pilot valve 22 is opened to allow the boom lowering pilot pressure Pbb having magnitude corresponding to the amount of the operation to be supplied through the boom lowering pilot line 34B to the boom lowering pilot port 16*b* of the boom control valve 16. The second merging selector valve 14 is, therefore, opened on condition that the boom raising operation with certain magnitude or more is applied to the boom operation lever 21.

The arm operation device 30 receives an arm operation by the operator, and causes the arm control valve 17 and further the first merging selector valve 13 to be opened in accordance with the arm operation. The arm operation device 30 corresponds to the "second main operation device" according to the present invention. The arm operation device 30 includes an arm operation lever 31, an arm pilot valve 32, an arm retracting pilot line 34A, an arm pushing pilot line 34B, and an arm retracting merging pilot line and an arm pushing merging pilot line that are not graphically shown.

The arm operation lever 31 is an operation member that receives, from the operator, the arm operation, which is a rotational movement operation for moving the arm cylinder 7, namely, a second main operation for moving the second main actuator. Specifically, the arm operation lever 31 is connected to the arm pilot valve 32 so as to be capable of rotational movement, and allowed to be operated by the operator on both sides of the neutral position, that is, allowed to receive an arm retracting operation and an arm pushing operation. Each of the arm retracting operation and the arm pushing operation is the arm operation corresponding to the "second main operation." The arm pushing operation corresponds to an operation for contracting the arm cylinder 7 to displace the tip attachment 3 in a raising direction, that is, a direction including an upward component against the gravity acting on the tip attachment 3.

The arm pilot valve 32 is opened to allow the pilot pressure to be supplied from the pilot hydraulic source to the arm control valve 17 and the second merging selector valve 14 in accordance with the arm operation applied to the arm operation lever 31. Specifically, the arm pilot valve 32 is connected to the arm retracting pilot port 17*a* and the arm pushing pilot port 17*b* of the arm control valve 17 through the arm retracting pilot line 34A and the arm pushing pilot line 34B, respectively. The arm pilot valve 32 is further connected to the arm retracting merging pilot port 13*a* and the arm pushing merging pilot port 13*b* of the first merging selector valve 13 through the arm retracting pilot line and the arm pushing pilot line branched off from the arm pushing pilot line 34.

The arm pilot valve 32 cuts off the supply of the pilot pressure when the arm operation lever 31 is at a neutral position. With application of the arm retracting operation to the arm operation lever 31, the arm pilot valve 32 is opened to allow the arm retracting pilot pressure Paa with magnitude corresponding to the amount of the operation to be supplied through the arm retracting pilot line 34A and further the arm retracting merging pilot line to the arm retracting pilot port 17*a* of the arm control valve 17 and furthermore the arm retracting merging pilot port 13*a* of the first merging selector valve 13. With application of the arm pushing operation to the arm operation lever 31, the arm pilot valve 32 is opened to allow the arm pushing pilot pressure Pab with magnitude corresponding to the amount of the operation to be supplied through the arm pushing pilot line 34B and further the arm pushing merging pilot line to the arm pushing pilot port 17*b* of the arm control valve 17 and further the arm pushing merging pilot port 13*b* of the first merging selector valve 13. The first merging selector valve 13 is, therefore, opened on condition that the arm operation (arm retracting operation and arm pushing operation) with a certain magnitude or more is applied to the arm operation lever 31.

The attachment operation device 40 receives an attachment operation by the operator and causes the attachment control valve 18 to be opened in accordance with the attachment operation. The attachment operation device 40 includes an attachment operation lever 41, an attachment pilot valve 42, an expansion pilot line 44A, and a contraction pilot line 44B.

The attachment operation lever 41 is an operation member that receives, from the operator, the attachment operation, which is a rotational movement operation for moving the attachment cylinder 8. Specifically, the attachment operation lever 41 is connected to the attachment pilot valve 42 so as to be capable of rotational movement, and allowed to be operated by the operator on both sides of the neutral position, that is, allowed to receive the expansion operation and the contraction operation. Each of the operations is the attachment operation, corresponding to the operation for expanding and contracting the attachment cylinder 8 so as to actuate the tip attachment 3.

The attachment pilot valve 42 is opened to allow the pilot pressure (attachment pilot pressure Pat) to be supplied from the pilot hydraulic source to the attachment control valve 18 in accordance with the attachment operation provided to the attachment operation lever 41. Specifically, the attachment pilot valve 42 is connected to the expansion pilot port 18*a* and the contraction pilot port 18*b* of the attachment control valve 18 through the expansion pilot line 44A and the contraction pilot line 44B, respectively.

The attachment pilot valve 42 cuts off the supply of the attachment pilot pressure Pat when the attachment operation lever 41 is at a neutral position. With application of the expansion operation to the attachment operation lever 41, the attachment pilot valve 42 is opened to allow the attachment pilot pressure Pat with magnitude corresponding to the amount of the operation to be supplied through the expansion pilot line 44A to the expansion pilot port 18*a* of the attachment control valve 18. With application of the contraction operation to the attachment operation lever 41, the attachment pilot valve 42 is opened to allow the attachment pilot pressure Pat with magnitude corresponding to the amount of the operation to be supplied through the contraction pilot line 44B to the contraction pilot port 18*b* of the attachment control valve 18.

In addition to the above components, the device shown in FIG. 1 includes a plurality of pilot pressure sensors, an input device 51, and a controller 60 functioning as a power distribution control device according to the present invention.

The plurality of pilot pressure sensors includes boom pilot pressure sensors 52A and 52B, arm pilot pressure sensors 53A and 53B, and attachment pilot pressure sensors 54A and 54B. The boom pilot pressure sensors 52A and 52B detect the boom raising pilot pressure Pba and the boom lowering pilot pressure Pbb that are input into the boom raising pilot port 16*a* and the boom lowering pilot port 16*b*, respectively. The arm pilot pressure sensors 53A and 53B detect the arm retracting pilot pressure Paa and the arm pushing pilot pressure Pab that are input into the arm retracting pilot port 17*a* and the arm pushing pilot port 17*b*, respectively. The attachment pilot pressure sensors 54A and 54B detect attachment pilot pressure Pat and Pat that are input into the attachment pilot ports 18*a* and 18*b*, respectively. Each of the pilot pressure sensors generates a pilot pressure detection signal, which is an electrical signal corresponding to the pilot pressure, and inputs the pilot pressure detection signal into the controller 60.

The input device 51 receives an input operation by the operator and inputs a change command corresponding to the input operation into the controller 60. The input operation includes a subtraction degree change operation (reduction degree change operation) and a mode specifying operation.

The subtraction degree change operation is an operation that is applied to the input device 51 in order to change the subtraction degree (reduction degree) stored in the controller 60 as will be described later. Receiving the subtraction degree change operation, the input device 51 generates a direct change command corresponding thereto, and inputs the direct change command into the controller 60 as the change command.

The mode specifying operation is an operation that is applied to the input device 51 in order to specify one working mode out of a plurality of working modes. The plurality of working modes correspond to types of attachment used as the tip attachment 3 in this embodiment. Examples of the plurality of working modes include a working mode with use of a large grinder as the tip attachment 3, a working mode with use of a small grinder, a working mode with use of a fork, a working mode with use of a breaker, and a working mode with use of a grapple. The input device 51 is capable of receiving the mode specifying operation, that is, an input operation by the operator for designating a working mode corresponding to the type of attachment installed in the tip of the arm 5 as the tip attachment 3. The input device 51 is configured to input a mode specifying command for specifying the working mode designated through the input operation, into the controller 60 as the change command.

The controller 60 includes a computer or the like, functioning as the power distribution control device according to the present invention. The power distribution control device is a device that controls distribution of power (pump torque) provided to the first hydraulic pump 11 and the second hydraulic pump 12 from the engine 10, which is a pump power source, by operating first pump displacement q1, which is the displacement of the first hydraulic pump 11, and second pump displacement q2, which is the displacement of the second hydraulic pump. Furthermore, the power distribution control device is configured to make the distribution of power from the engine 10 to the second hydraulic pump 12 smaller and to make the distribution of power from the engine 10 to the first hydraulic pump 11 larger when a combined operational action is performed than when an arm pushing single operational action is performed. The combined operational action according to this embodiment includes a specified combined operational action according to the present invention, and specific definition thereof will be described in detail later. The second main single operational action is an action of applying the arm pushing operation (second main operation) to the arm operation device 30 while not applying the attachment operation to the attachment operation device 40.

Figure 3:
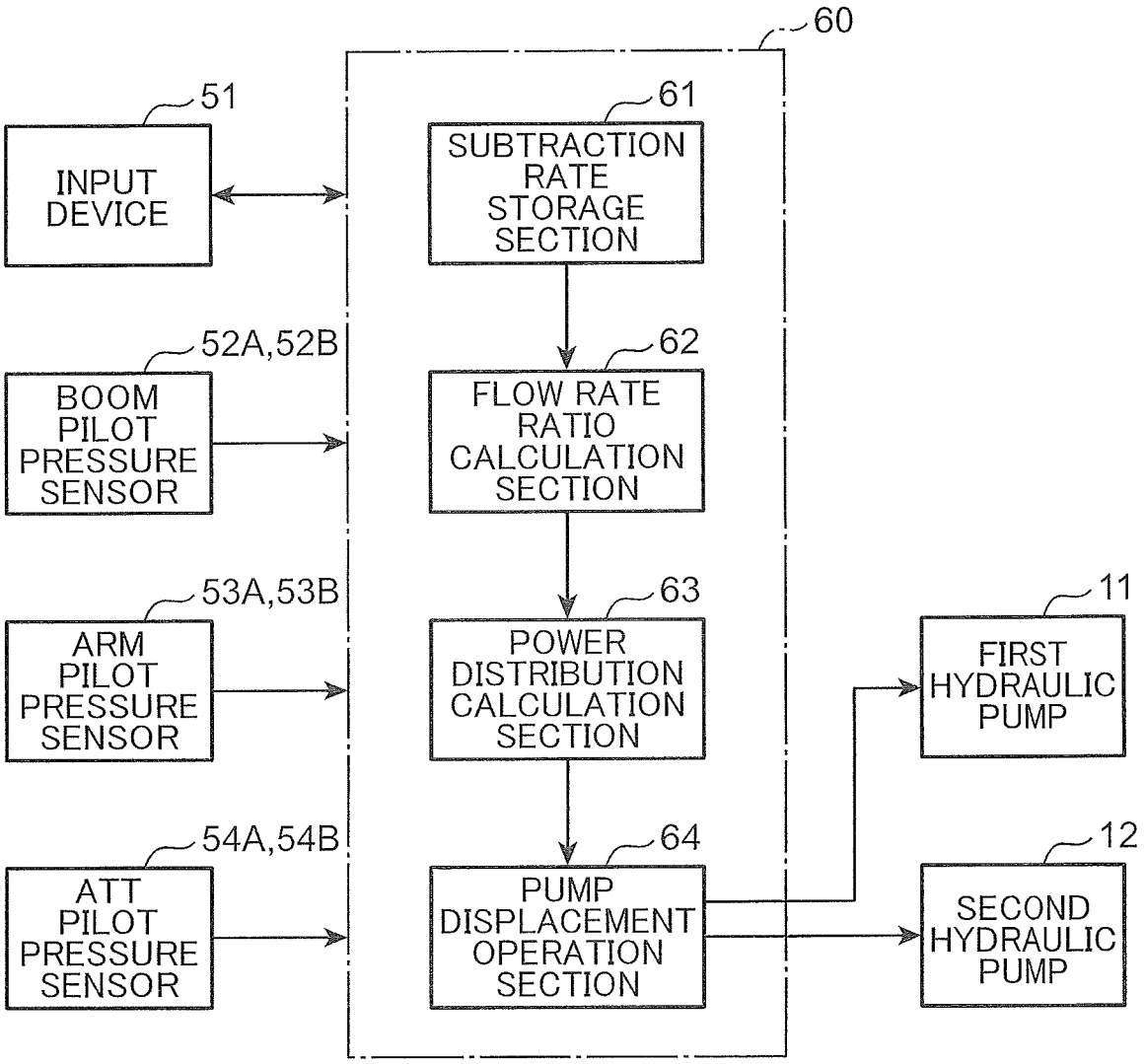
FIG. 3 is a block diagram showing a functional configuration of a controller of the hydraulic driving apparatus and input and output signals of the controller.

Specifically, the controller 60 includes, as functions related to the power distribution control device, a subtraction rate storage section (subtraction rate storage section) 61, a flow rate ratio calculation section 62, a power distribution calculation section 63, and a pump displacement operation section 64 as shown in FIG. 3.

The subtraction rate storage section 61 stores the subtraction degree (reduction degree) to be used by the flow rate ratio calculation section 62, and designates the subtraction degree to the flow rate ratio calculation section 62. Furthermore, as will be described in detail later, when receiving the input of the change command (at least one of the direct change command and the mode specifying command) from the input device 51, the subtraction rate storage section 61 changes the subtraction degree based on the change command. The subtraction rate storage section 61 also stores change allowable ranges corresponding to the plurality of working modes. When the change in the subtraction degree by the direct change command exceeds the change allowable ranges, the subtraction rate storage section 61 rejects the change.

The flow rate ratio calculation section 62 calculates the flow rate ratio based on the boom operation, the arm operation, and the attachment operation. The flow rate ratio is a ratio between a 1-speed boom flow rate, a 1-speed arm flow rate, an attachment flow rate, a 2-speed arm flow rate, and a 2-speed boom raising flow rate. The 1-speed boom flow rate is a flow rate of hydraulic fluid to be supplied from the first hydraulic pump 11 to the boom cylinder 6 as the first main actuator (first main flow rate). The 1-speed arm flow rate is a flow rate of hydraulic fluid to be supplied from the second hydraulic pump 12 to the arm cylinder 7 as the second main actuator (second main flow rate). The attachment flow rate is a flow rate of hydraulic fluid to be supplied from the second hydraulic pump 12 to the attachment cylinder 8 as the attachment actuator. The 2-speed arm flow rate is a flow rate of hydraulic fluid to be supplied from the first hydraulic pump 11 to the arm cylinder 7 through the first merging selector valve 13 (first merging flow rate). The 2-speed boom raising flow rate is a flow rate of hydraulic fluid to be supplied from the second hydraulic pump 12 to the boom cylinder 6 through the second merging selector valve 14 (second merging flow rate).

To determine the flow rate ratio, the flow rate ratio calculation section 62 according to this embodiment calculates a 1-speed boom target flow rate Qb1, a 1-speed arm target flow rate Qa1, an attachment target flow rate Qat, a 2-speed arm target flow rate Qa2, and a 2-speed boom target flow rate Qb2, which are respective target values of the 1-speed boom flow rate, the 1-speed arm flow rate, the attachment flow rate, the 2-speed arm flow rate, and the boom 2-speed flow rate. These target flow rates Qb1, Qa1, Qat, Qa2, and Qb2 are tentatively calculated only for determining the flow rate ratio which is the ratio between the flow rates; thus, the magnitude of the target flow rate does not necessarily correspond to the magnitude of the flow rate of hydraulic fluid actually flowing in each actuator. Specifically, the flow rate ratio is determined as a ratio between the target flow rates Qb1, Qa1, Qat, Qa2, and Qb2, while the sum of the target flow rates Qb1, Qa1, Qat, Qa2, and Qb2 is restricted according to the horsepower of the engine 10.

The subtraction rate storage section 61 stores an arm pushing subtraction rate Ra and a boom raising subtraction rate Rb as the subtraction degree. The arm pushing subtraction rate Ra is a subtraction rate corresponding to an arm pushing operation out of the arm operations applied to the arm operation device 30, the arm pushing operation being an operation for moving the arm cylinder 7 in a raising direction, that is, an operation for operating the arm cylinder 7 in a direction to displace the arm 5 upward (Ra≤100%). The boon raising subtraction rate Rb is a subtraction rate corresponding to a boom raising operation out of the boom operations applied to the boom operation device 20, the boom raising operation being an operation for moving the boom cylinder 6 in a raising direction, that is, an operation for operating the boom cylinder 6 in a direction to displace the boom 4 upward (Rb 100%). As will be described in detail later, when the combined operational action is performed, the flow rate ratio calculation section 62 subtracts the attachment target flow rate Qat with use of the arm pushing subtraction rate Ra and the boom raising subtraction rate Rb.

The power distribution calculation section 63 calculates power distribution from the engine 10 to the first hydraulic pump 11 and the second hydraulic pump 12, based on the target flow rate calculated by the flow rate ratio calculation section 62.

The pump displacement operation section 64 operates the first pump displacement q1 and the second pump displacement q2 so as to obtain the power distribution calculated by the power distribution calculation section 63. Specifically, the pump displacement operation section 64 inputs the displacement command signals into the regulators 11*a* and 12*a* of the first and second hydraulic pumps 11 and 12, respectively, to adjust the first pump displacement q1 and the second pump displacement q2.

Figure 4:
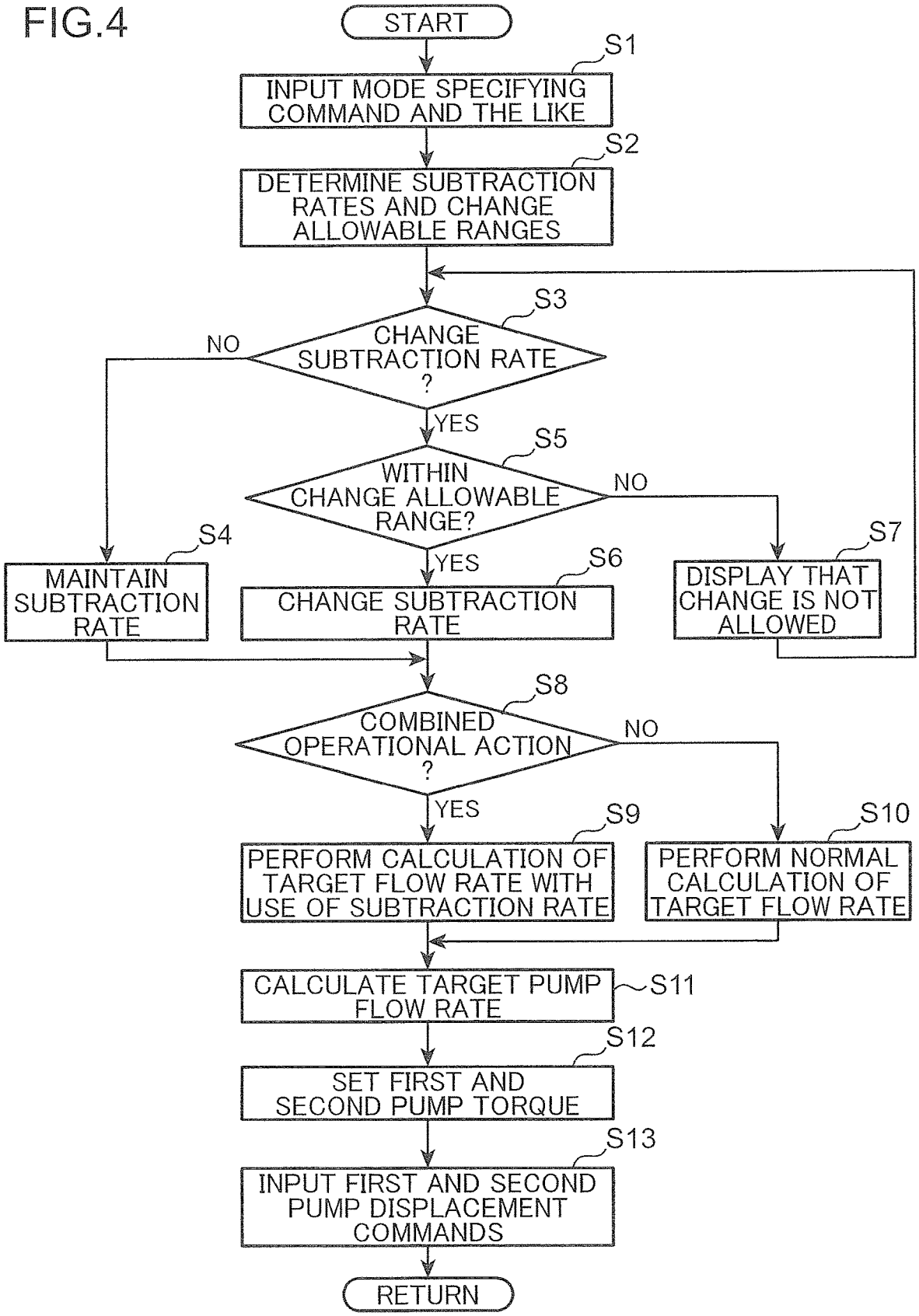
FIG. 4 is a flowchart showing a calculation control operation made by the controller as a power distribution control device.

Next will be described a calculation control operation to be performed by the controller 60 with reference to the flowchart of FIG. 4.

First, an input operation is applied to the input device 51 by the operator, and the input device 51 inputs a change command into the subtraction rate storage section 61 of the controller 60 based on the input operation (step S1). The input operation includes at least a mode designating operation, that is, an operation for designating a working mode corresponding to the tip attachment 3 installed in the arm 5 from the plurality of working modes. The input operation further includes, as necessary, a subtraction rate changing operation, that is, an operation for directly changing the arm pushing subtraction rate Ra and the boom raising subtraction rate Rb to be used by the flow rate ratio calculation section 62. The input device 51 generates the mode specifying command and the direct change command based on the mode designating operation and the subtraction rate changing operation, respectively, and inputs the commands into the subtraction rate storage section 61.

Based on the working mode specified by the mode specifying command, the subtraction rate storage section 61 determines the subtraction rates Ra and Rb to be used for calculation of each target flow rate and the change allowable ranges thereof (step S2). For example, for a working mode in which a heavy attachment for which the load for raising the boom or pushing the arm to lift the attachment can be easily increased, such as a grinder, is used as the tip attachment 3, a subtraction rate much smaller than 1 (for example, 80%) is employed as the subtraction rates Ra and Rb. In contrast, for example, for a working mode in which a relatively light attachment for which the load for raising the boom or pushing the arm to lift the attachment cannot be easily increased, such as a fork or a breaker, is used as the tip attachment 3, a subtraction rate relatively close to 1 (including 100%, that is, one with no subtraction) is employed as the subtraction rates Ra and Rb.

When the direct change command is not input, that is, when the input operation does not include the subtraction rate changing operation (NO in step S3), the subtraction rate storage section 61 maintains the subtraction rates Ra and Rb determined based on the working mode (step S4). In contrast, when the subtraction rate changing operation is included (YES in step S3), the subtraction rate storage section 61 judges whether or not the change in the subtraction rates Ra and Rb related to the subtraction rate changing operation is within the change allowable range determined based on the working mode (step S5). When the change is within the change allowable range (YES in step S5), the subtraction rate storage section 61 changes the subtraction rate based on the subtraction rate changing operation (step S6). When the change exceeds the change allowable range (NO in step S5), the subtraction rate storage section 61 rejects the change in the subtraction rates Ra and Rb and causes the input device 51 to display that the change is not allowed (step S7). When the subtraction degree change operation is performed again following the display, the subtraction rate storage section 61 judges whether or not the change should be allowed, in the same manner as described above (step S4).

Next, the flow rate ratio calculation section 62 of the controller 60 calculates each target flow rate for specifying the flow rate ratio (steps S8 to S10). Specifically, when the combined operational action is performed on the arm operation device 30 and the attachment operation device 40 (YES in step S8), the flow rate ratio calculation section 62 performs calculation of the target flow rate with use of the subtraction rates Ra and Rb designated through the subtraction rate storage section 61 (step S9). Otherwise (NO in step S8), the flow rate ratio calculation section 62 performs normal calculation of the normal target flow rate with no use of the subtraction rates Ra and Rb (step S10).

In this embodiment, the "combined operational action" includes a first combined operational action, a second combined operational action, and a third combined operational action. The first combined operational action is an action of simultaneously applying the boom raising operation and the attachment operation to the boom operation device 20 and the attachment operation device 40, respectively. The second combined operational action is an action of simultaneously applying the arm pushing operation and the attachment operation to the arm operation device 30 and the attachment operation device 40, respectively. The third combined operational action is an action of simultaneously applying the boom raising operation, the arm pushing operation, and the attachment operation to the boom operation device 20, the arm operation device 30, and the attachment operation device 40, respectively. Hence, in this embodiment, the calculation of the target flow rate with use of the subtraction rates Ra and Rb is performed when any one of the first to third combined operational actions is performed.

What corresponds to the "specified combined operation" according to the present invention is an action of simultaneously applying the second main operation at least with respect to a raising direction (arm pushing operation in this embodiment) and the attachment operation to the arm operation device 30 and the attachment operation device 40, namely, the second combined operational action or the third combined operational action. Therefore, the present invention does not require that the calculation of the attachment target flow rate Qat with use of the subtraction rates Ra and Rb is performed when the first combined operational action is made.

According to the normal target flow rate calculation, respective target flow rates are calculated based on the pilot pressure detected by the pilot pressure sensors 52A, 52B, 53A, 53B, 54A, and 54B in order to perform so-called positive control. Specifically, each of the 1-speed boom target flow rate Qb1 and the 2-speed boom target flow rate Qb2 is set at a flow rate Qpb correspond to the magnitude of the boom raising pilot pressure Pba or the boom lowering pilot pressure Pbb detected by the boom pilot pressure sensor 52A or 52B, respectively; each of the 1-speed arm target flow rate Qa1 and the 2-speed arm target flow rate Qa2 is set at a flow rate Qpa corresponding to the magnitude of the arm retracting pilot pressure Paa or the arm pushing pilot pressure Pab detected by the arm pilot pressure sensor 53A or 53B; and the attachment target flow rate Qat is set at a flow rate Qpt corresponding to the magnitude of the attachment pilot pressure Pat detected by the attachment pilot pressure sensor 54A or 54B. In summary, according to the normal target flow rate calculation, each target flow rate is set as follows.

$$Qb1=Qb2=Qpb$$

$$Qa1=Qa2=Qpa$$

$$Qat=Qpt$$

Figure 6:
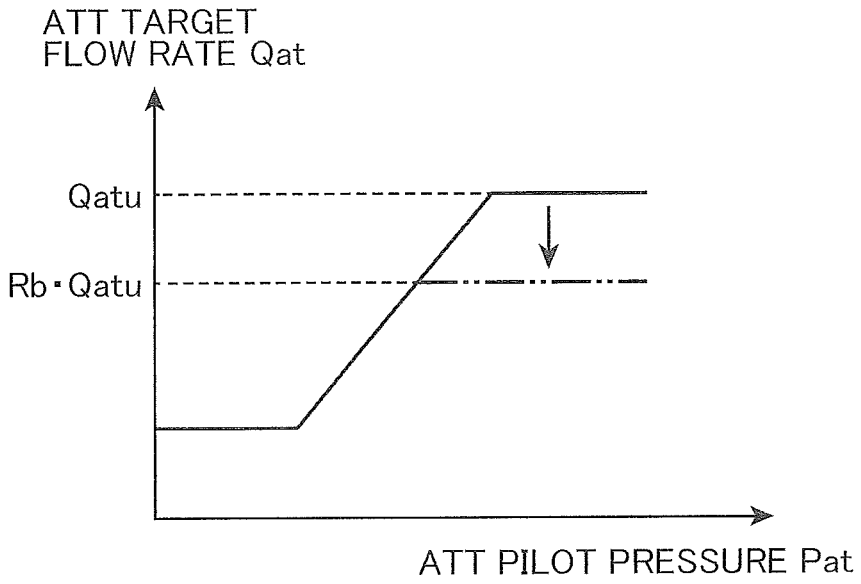
FIG. 6 is a graph showing a relationship between an attachment pilot pressure Pat and the attachment target flow rate Qat to be set based on the boom raising pilot pressure Pba by the controller in the hydraulic driving apparatus.
Figure 8:
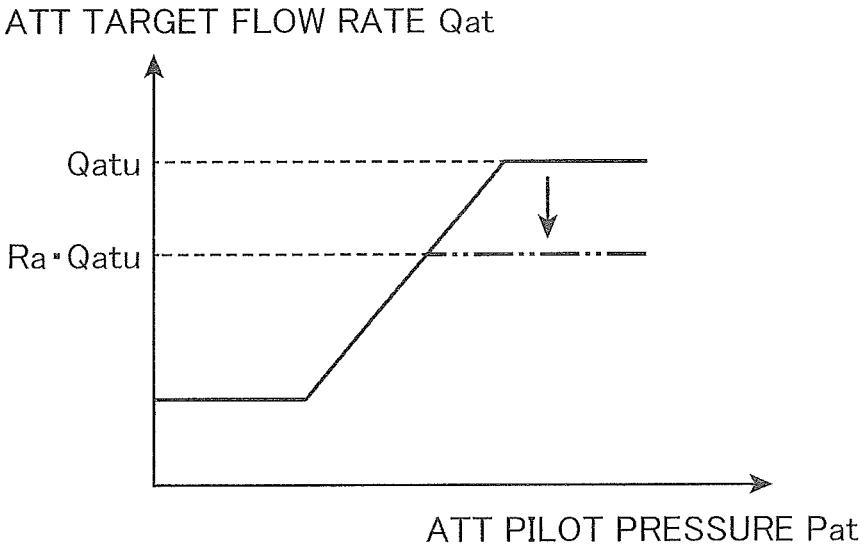
FIG. 8 is a graph showing a relationship between the attachment pilot pressure Pat and the attachment target flow rate Qat to be set based on the arm pushing pilot pressure Pab by the controller in the hydraulic driving apparatus.

FIGS. 6 and 8 are graphs showing, as an example, characteristics of the attachment target flow rate Qat to the attachment pilot pressure Pat.

Figure 5:
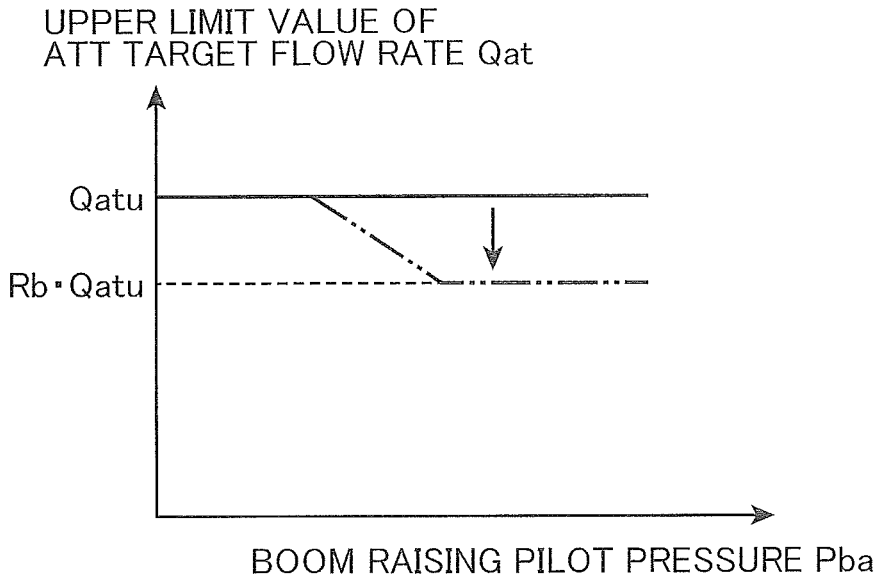
FIG. 5 is a graph showing a relationship between a boom raising pilot pressure Pba and an upper limit value of an attachment target flow rate Qat to be set by the controller in the hydraulic driving apparatus.
Figure 7:
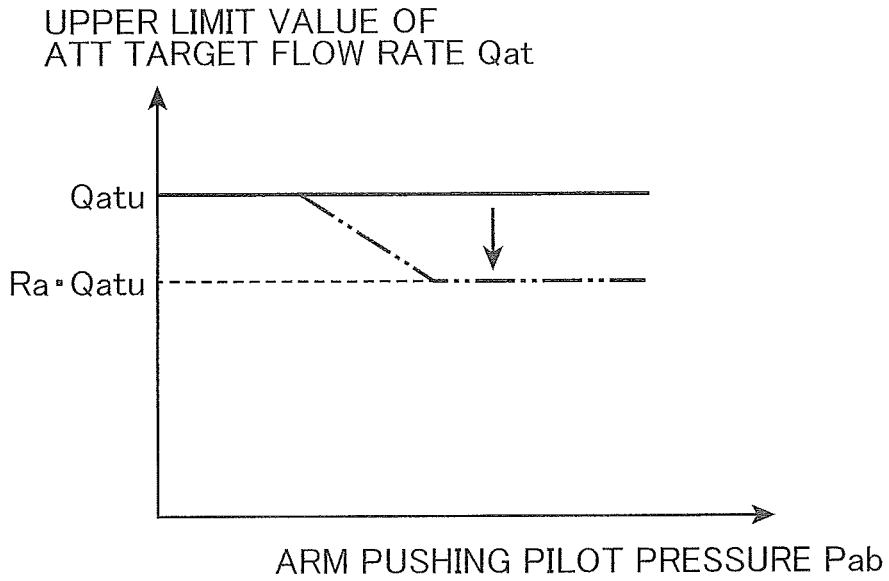
FIG. 7 is a graph showing a relationship between an arm pushing pilot pressure Pab and the upper limit value of the attachment target flow rate Qat to be set by the controller in the hydraulic driving apparatus.

In contrast, when one of the first to third combined operational actions is performed, the flow rate ratio calculation section 62 performs the subtraction (reduction) of an upper limit value Qatu in correspondence with the boom raising operation and the subtraction (reduction) of the upper limit value Qatu in correspondence with the arm pushing operation, by multiplying the upper limit value Qatu of the attachment target flow rate Qat by the boom raising subtraction rate Rh and the arm pushing subtraction rate Ra, respectively. In this embodiment, as indicated by alternate long and short dashed lines in FIGS. 5 and 7, the smaller values of the subtraction rates Rb and Ra (values that increase the subtraction degree of the upper limit value Patu) are set for the larger boom raising pilot pressure Pba and the greater arm pushing pilot pressure Pab. This results in the subtraction (reduction) of the attachment target flow rate Qat corresponding to the attachment pilot pressure Pat as indicated by alternate long and short dashed lines in FIGS. 6 and 8.

When the third combined operational action is performed, there may be employed, as the attachment target flow rate Qat, either the average value of the flow rate calculated with use of the arm pushing subtraction rate Ra and the flow rate calculated with use of the boom raising subtraction rate Rb or the lower one of the former flow rate and the latter flow rate. Alternatively, it is also acceptable to employ the flow rate obtained by adding the former flow rate and the latter flow rate to thereby perform such a control as to increase a second target pump flow rate Q2 with an increase in a first target pump flow rate Q1 caused by adding a boom raising 1-speed target flow rate Qb1 and an arm pushing 2-speed target flow rate Qa2 as will be described later to balance the operating speed of each actuator.

Figure 9:
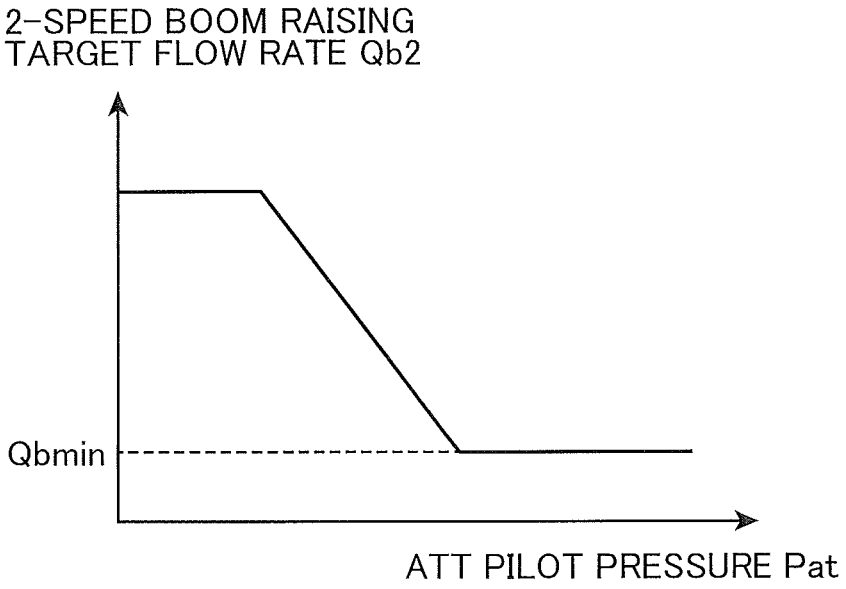
FIG. 9 is a graph showing a relationship between the attachment pilot pressure Pat and a 2-speed boom raising target flow rate Qb2 to be set by the controller in the hydraulic driving apparatus.
Figure 10:
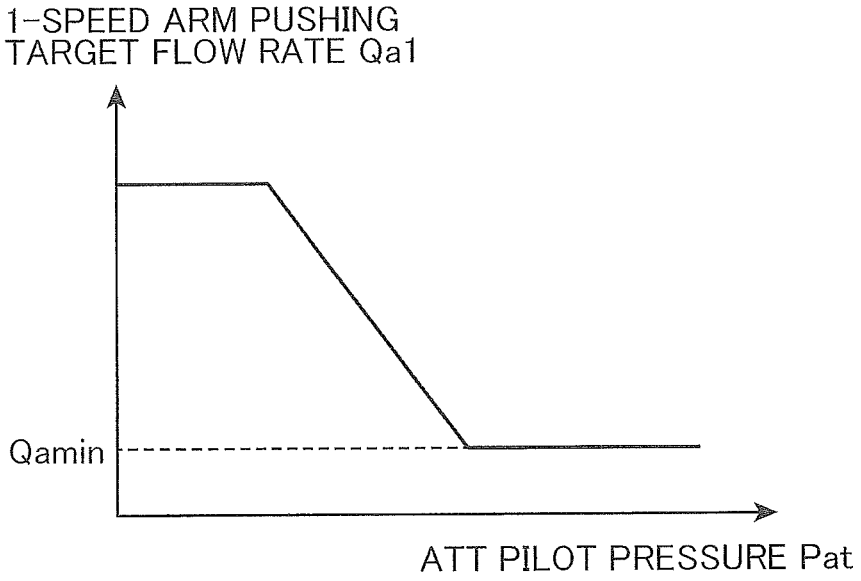
FIG. 10 is a graph showing a relationship between the attachment pilot pressure Pat and a 1-speed arm pushing target flow rate Qa1 to be set by the controller in the hydraulic driving apparatus.

Furthermore, as shown in FIGS. 9 and 10, the flow rate ratio calculation section 62 in this embodiment subtracts the 2-speed boom target flow rate (2-speed boom raising target flow rate) Qb2 and the 1-speed arm target flow rate (1-speed arm pushing target flow rate) Qa1 related to the second hydraulic pump 12 with a greater degree for the larger attachment pilot pressure Pat. Specifically, when the attachment pilot pressure Pat is sufficiently large (for example, when the full operation is applied to the attachment operation lever 41), the target flow rates Qb2 and Qa1 are limited to respective minimum values Qbmin and Qamin each being close to zero.

Therefore, when the boom raising pilot pressure Pba and the arm pushing pilot pressure Pab are sufficiently large, the target flow rates are set as follows.

Qb1=Qpb
Qb2=Qbmin (minimum value)
Qa1=Qamin (minimum value)
Qa2=Qpa
Qat=Ra (or Rb) Qpa Wherein, the target flow rates Qb1 and Qa2 that have not undergone the subtraction are the flow rates of the hydraulic fluid supplied from the first hydraulic pump 11, whereas the target flow rates Qb2, Qa1, and Qat that have undergone the subtraction are the flow rates of the hydraulic fluid supplied from the second hydraulic pump 12. The subtraction is, thus, to increase the priority of the first hydraulic pump 11 and decrease the priority of the second hydraulic pump 12, with respect to the power distribution from the engine 10.

When other hydraulic actuators than the cylinders 6 to 8 are connected to the first and second hydraulic pumps 11 and 12, the flow rate ratio calculation section 62 similarly calculates the target flow rates of the other hydraulic actuators. Also in this case, the priority of the first hydraulic pump 11 is still higher than the priority of the second hydraulic pump 12.

Next, the power distribution calculation section 63 of the controller 60 calculates the power distribution to the first and second hydraulic pumps 11 and 12 based on the target flow rate (flow rate ratio) calculated by the flow rate ratio calculation section 62. Specifically, the power distribution calculation section 63 calculates, based on the target flow rate, the first target pump flow rate Q1 and the second target pump flow rate Q2, which are target values of the flow rate of the hydraulic fluid discharged from the first and second hydraulic pumps 11 and 12, respectively (step S11). Then, the power distribution calculation section 63 sets, based on the target pump flow rates Q1 and Q2, first pump torque T1 and second pump torque T2, which are respective drive torques of the first and second hydraulic pumps 11 and 12 (step S12).

The first target pump flow rate Q1 and the second target pump flow rate Q2 are represented by the following formulas.

$$Q1=Qb1+Qa2+Qc1$$

$$Q2=Qa1+Qat+Qb2+Qc2$$

Wherein, Qc1 is the sum of the target flow rates of other hydraulic actuators than the cylinders 6 to 8 when the other hydraulic actuators are connected to the first hydraulic pump 11, and Qc2 is the sum of the target flow rates of other hydraulic actuators than the cylinders 6 to 8 when the other hydraulic actuators are connected to the second hydraulic pump 12. According to the first combined operational action, the flow rates Qa1 and Qa2 are zero, whereas, according to the second combined operational action, the flow rates Qb1 and Qb2 are zero. Besides, when any one of the first to third combined operational actions is performed, the target flow rates Qat, Qb2, and Qa1 are all subtracted; thefrefore, the second target pump flow rate Q2 including the target flow rates Qat, Qb2, and Qa1 is more greatly subtracted than the first target pump flow rate Q1.

The first pump torque T1 and the second pump torque T2 are calculated by the following formulas, where Tt is overall limit torque which is the upper limit value of the total torque defined by the horsepower of the engine 10.

$$T1=Tt\times Q1/(Q1+Q2)$$

$$T2=Tt\times Q2/(Q1+Q2)$$

The pump displacement operation section 64 of the controller 60 performs: calculating a final first pump flow rate (discharge flow rate of the first hydraulic pump 11) and a second pump flow rate (discharge flow rate of the second hydraulic pump 12) corresponding to the first pump torque T1 and the second pump torque T2, respectively; determining the first pump displacement q1 and the second pump displacement q2 for obtaining the first pump flow rate and the second pump flow rate; and inputting the corresponding displacement command signals corresponding to the determined first pump displacement q1 and the second pump displacement q2, respectively, into the regulators 11*a* and 12*a* of the first and second hydraulic pumps 11 and 12 (step S13). The calculation of the first and second pump flow rates includes dividing the first and second pump torque T1 and T2 by the discharge pressure of the first and second hydraulic pumps 11 and 12, respectively. However, regardless of the division by the discharge pressure of the first and second hydraulic pumps 11 and 12, the finally calculated ratios of the first and second pump flow rates to each other corresponds to the ratios of the first and second pump torque T1 and T2 to each other, because the discharge pressures of both the hydraulic pumps 11 and 12 can be regarded as being substantially equal to each other for the merge of hydraulic fluid discharged from the first hydraulic pump 11 with hydraulic fluid discharged from the second hydraulic pump 12.

At least when the specified combined operational action is performed, that is, when the arm pushing operation and the attachment operation are simultaneously applied to the arm operation device 30 and the attachment operation device 40, respectively (in this embodiment, when the second and third combined operational actions are performed), the apparatus described above makes it possible to limit the flow rate of the hydraulic fluid supplied from the second hydraulic pump 12 to the attachment cylinder 8 by reducing the priority of the second hydraulic pump 12 with respect to the power distribution of power to the first and second hydraulic pumps 11 and 12 while securing the flow rate of the hydraulic fluid supplied from the first hydraulic pump 11 to the arm cylinder 7 through the first merging selector valve 13 (according to the third combined operational action, the hydraulic fluid supplied from the first hydraulic pump 11 to the boom cylinder 6 and the arm cylinder) by increasing the priority of the first hydraulic pump 11 with respect to the power distrihusion. This makes it possible to secure a sufficient operating speed of the arm cylinder 7 (arm cylinder 7 and boom cylinder 6 according to the third combined operational action) while limiting the operating speed of the attachment cylinder 8 with no requirement for a dedicated variable throttle valve even when the load for arm pushing (arm pushing and boom raising according to the third combined operational action) is significantly larger than the load for driving the tip attachment 3 when the specified combined operational action is performed. This effect is similarly obtained also in the case where the first main actuator is the arm cylinder 7 and the second main actuator is the boom cylinder 6.

The present invention is not limited to the embodiment described above. The present invention also includes, for example, the following modes.

(A) about the Flow Rate Ratio Subtraction Degree

The flow rate ratio subtraction degree for subtracting the attachment target flow rate in the present invention is not limited to the subtraction rates Rb and Ra defined in the embodiment. The flow rate ratio subtraction degree may be set, for example, as a subtraction value to be subtracted from the attachment target flow rate. Alternatively, there may be provided a non-linear relationship between the magnitude of the arm pushing operation or boom raising operation and the attachment target flow rate as a relational expression or a map, based on which the flow rate ratio calculation section calculates the attachment target flow rate.

(B) About Subtraction of the Second Main Flow Rate and the Second Merging Flow Rate The present invention does not absolutely require the subtraction of the second main flow rate (1-speed arm pushing target flow rate Qa1 in the embodiment) or the second merging flow rate (2-speed boom raising target flow rate Qb2 in the embodiment) when the specified combined operational action is performed. The subtraction, however, makes it possible to further increase the priority of the first hydraulic pump for power distribution to enable the first main actuator and the second main actuator to be driven by the hydraulic fluid supplied from the first hydraulic pump (not the second hydraulic pump) in an increased proportion.

As described above, provided is a hydraulic driving apparatus for hydraulically driving a working device of a work machine, the hydraulic driving apparatus including an arm actuator, a boom actuator and an attachment actuator for driving a tip attachment, either the boom actuator or the arm actuator and the attachment actuator being connected to a common hydraulic pump, the apparatus being capable of actuating each of the actuators at a preferred speed. Provided is a hydraulic driving apparatus provided in a work machine including a working device to hydraulically drive the working device, the working device including a boom that is capable of being raised and lowered, an arm connected to a tip of the boom so as to be capable of rotational movement, and a tip attachment attached to a distal end of the arm. The hydraulic driving apparatus includes: a boom actuator configured to receive supply of hydraulic fluid to thereby raise and lower the boom; an arm actuator configured to receive supply of hydraulic fluid to thereby bring the arm into rotational movement; an attachment actuator configured to receive supply of hydraulic fluid to thereby actuate the tip attachment; a pump power source configured to generate power; a first hydraulic pump that is a variable displacement pump to be connected to a first main actuator that is selected from the boom actuator and the arm actuator, the first hydraulic pump being configured to be operated by the power provided from the pump drive source so as to discharge hydraulic fluid to supply the hydraulic fluid to the first main actuator; a second hydraulic pump that is a variable displacement pump connected to a second main actuator and the attachment actuator, the second main actuator being one of the boom actuator and the arm actuator and different from the first main actuator, the second hydraulic pump being configured to be operated by the power provided from the pump drive source so as to discharge hydraulic fluid to supply the hydraulic fluid to the second main actuator and the attachment actuator; a first main control valve interposed between the first hydraulic pump and the first main actuator, the first main control valve being operable to change a flow rate of hydraulic fluid supplied from the first hydraulic pump to the first main actuator; a second main control valve interposed between the second hydraulic pump and the second main actuator, the second main control valve being operable to change a flow rate of hydraulic fluid supplied from the second hydraulic pump to the second main actuator; an attachment control valve interposed between the second hydraulic pump and the attachment actuator, the attachment control valve being operable to change a flow rate of hydraulic fluid supplied from the second hydraulic pump to the attachment actuator; a first main operation device configured to receive a first main operation for moving the first main actuator and to operate the first main control valve in accordance with the first main operation; a second main operation device configured to receive a second main operation for moving the second main actuator and to operate the second main control valve in accordance with the second main operation; an attachment operation device configured to receive an attachment operation for moving the attachment actuator and to operate the attachment control valve in accordance with the attachment operation; a first merging selector valve provided between the first hydraulic pump and the second main actuator, the first merging selector valve being configured to be opened, on condition that the second main operation for operating the second main actuator at least in a raising direction is applied to the second main operation device, to allow hydraulic fluid discharged from the first hydraulic pump to merge with hydraulic fluid discharged from the second hydraulic pump to be supplied to the second main actuator; and a power distribution control device configured to operate first pump displacement that is displacement of the first hydraulic pump and second pump displacement that is displacement of the second hydraulic pump to thereby control distribution of the power provided from the pump power source to the first hydraulic pump and the second hydraulic pump. The power distribution control device is configured to operate the first pump displacement and the second pump displacement so as to make the distribution of the power from the pump drive source to the second hydraulic pump be smaller and to make the distribution of the power from the pump drive source to the first hydraulic pump be larger when a specified combined operational action is performed on the second main operation device and the attachment operation device than when a second main single operational action is applied to the second main operation device. The specified combined operational action is an action of applying the second main operation for operating the second main actuator in the raising direction to the second main operation device to thereby open the first merging selector valve while simultaneously applying the attachment operation to the attachment operation device. The second main single operational action is an action of applying the second main operation to the second main operation device while not applying the attachment operation to the attachment operation device.

This apparatus makes is possible, when the specified combined operational action is performed, that is, when the second main operation and the attachment operation are simultaneously applied to the second main operation device and the attachment operation device, respectively, to limit the flow rate of the hydraulic fluid supplied from the second hydraulic pump to the attachment actuator by decreasing the priority of the second hydraulic pump with respect to the power distribution to the first and second hydraulic pumps while securing the flow rate of the hydraulic fluid supplied from the first hydraulic pump to the second main actuator through the first merging selector valve by increasing the priority of the first hydraulic pump. This makes it possible to secure the sufficient operating speed of the second main actuator while limiting the operating speed of the attachment actuator with no requirement for a dedicated variable throttle valve even when the load of the second main actuator is significantly larger than the load of the attachment actuator when the specified combined operational action is performed.

Specifically, it is preferable that the power distribution control device includes: a flow rate ratio calculation section configured to calculate a flow rate ratio, based on the first main operation, the second main operation, and the attachment operation, the flow rate ratio being a ratio between a first main flow rate that is a flow rate of hydraulic fluid to be supplied from the first hydraulic pump to the first main actuator, a second main flow rate that is a flow rate of hydraulic fluid to be supplied from the second hydraulic pump to the second main actuator, an attachment flow rate that is a flow rate of hydraulic fluid to be supplied from the second hydraulic pump to the attachment actuator, and a first merging flow rate that is a flow rate of hydraulic fluid to be supplied from the first hydraulic pump to the second main actuator through the first merging selector valve; a power distribution calculation section configured to calculate a power distribution of the first hydraulic pump and the second hydraulic pump, the power distribution being the distribution of respective powers to be provided to the first hydraulic pump and the second hydraulic pump, based on the flow rate ratio calculated by the flow rate ratio calculation section; and a pump displacement operation section configured to operate the first pump displacement and the second pump displacement to obtain the calculated power distribution, and that the flow rate ratio calculation section is configured to subtract a ratio of the attachment flow rate in accordance with the second main operation applied to the second main operation device in the specified combined operational action (preferably, with greater subtraction degree for the larger second main operation). This configuration makes it possible to decrease priority to the second hydraulic pump for power distribution (increase priority to the first hydraulic pump) by reducing the flow rate ratio of the attachment actuator, when the second main operation is large, that is, when the load of the second main actuator is large, while taking account of the first main operation, the second main operation, and the attachment operation that are applied to respective operation devices.

More preferably, the flow rate ratio calculation section is configured to subtract a ratio of the second main flow rate in accordance with the attachment operation applied to the attachment operation device in the specified combined operational action (preferably, with greater subtraction degree for the larger attachment operation). This makes it possible to further increase the priority of the first hydraulic pump for power distribution to enable the second main actuator to be driven by the hydraulic fluid supplied from the first hydraulic pump (not the second hydraulic pump) in a further increased proportion.

The hydraulic driving apparatus may further include, in addition to the first merging selector valve, a second merging selector valve provided between the second hydraulic pump and the first main actuator, the second merging selector valve being configured to be opened, on condition that the first main operation at least with respect to a raising direction is applied to the first main operation device, to allow the hydraulic fluid discharged from the second hydraulic pump to merge with the hydraulic fluid discharged from the first hydraulic pump and to be supplied to the first main actuator. In this case, it is more preferably that the flow rate ratio calculation section is configured to calculate a flow rate ratio that is a ratio between the first main flow rate, the second main flow rate, the attachment flow rate, the first merging flow rate, and a second merging flow rate that is a flow rate of hydraulic fluid to be supplied from the second hydraulic pump to the first main actuator through the second merging selector valve, and to subtract a ratio of the second merging flow rate in accordance with the attachment operation applied to the attachment operation device when the specified combined operational action is performed (preferably, with greater subtraction degree for the larger attachment operation). This makes it possible to maintain the high priority of the first hydraulic pump for power distribution (low priority of the second hydraulic pump) by limiting the ratio of the second merging flow rate, that is, the flow rate of hydraulic fluid to be supplied from the second hydraulic pump to the first main actuator, regardless of the opening of the second merging selector valve caused by the specified combined operational action.

Although the flow rate ratio subtraction degree, which is the subtraction degree of the attachment flow rate ratio, may be fixed to a preset degree, it may be changed depending on preference of the operator. Specifically, it is preferable that the hydraulic driving apparatus further includes: a subtraction degree storage section configured to store the flow rate ratio subtraction degree and to designate the flow rate ratio subtraction degree to the flow rate ratio calculation section; and a change command input section configured to input a command for changing the flow rate ratio subtraction degree into the subtraction degree storage section, and that the subtraction degree storage section is configured to change the flow rate ratio subtraction degree based on the change command that is input from the change command input section.

For example, the change command input section is preferably configured to receive a subtraction degree change operation for changing the flow rate ratio subtraction degree and to input a direct change command corresponding to the subtraction degree change operation into the subtraction degree storage section.

The flow rate ratio subtraction degree, alternatively, may be changed depending on a plurality of working modes (for example, an attachment mode corresponding to the type of the tip attachment attached to in the distal end of the arm). Specifically, the following configuration is preferable. The subtraction degree storage section is configured to store a plurality of flow rate ratio subtraction degrees corresponding to a plurality of working modes, respectively, as the flow rate ratio subtraction degree. The change command input section is configured to input a mode specifying command for specifying a predetermined working mode from the plurality of working modes into the subtraction degree storage section as the change command. The subtraction degree storage section is configured to select the flow rate ratio subtraction degree corresponding to the working mode specified by the mode specifying command from the plurality of working modes and to designate the flow rate ratio subtraction degree to the flow rate ratio calculation section.

Also in this aspect, it is preferable that the change command input section is configured to receive the subtraction degree change operation and to input the direct change command corresponding to the subtraction degree change operation into the subtraction degree storage section. In this case, it is more preferable that the subtraction degree storage section is configured to store a plurality of change allowable ranges corresponding to the plurality of working modes, respectively, and to allow the flow rate ratio subtraction degree to be changed only within the change allowable range corresponding to the designated working mode. The setting of the plurality of change allowable ranges makes it possible to restrict the change in the flow rate ratio subtraction degree in each working mode within a degree suitable for the working mode.

This application is based on Japanese Patent application No. 2018-127604 filed in Japan Patent Office on Jul. 4, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A hydraulic driving apparatus provided in a work machine including a working device to hydraulically drive the working device, the working device including a boom capable of being raised and lowered, an arm connected to a tip of the boom so as to be capable of rotational movement, and a tip attachment attached to a distal end of the arm, the hydraulic driving apparatus comprising:

a boom actuator configured to receive supply of hydraulic fluid to thereby raise and lower the boom;

an arm actuator configured to receive supply of hydraulic fluid to thereby bring the arm into rotational movement;

an attachment actuator configured to receive supply of hydraulic fluid to thereby actuate the tip attachment;

a pump power source configured to generate power;

a first hydraulic pump that is a variable displacement pump to be connected to a first main actuator that is selected from the boom actuator and the arm actuator, the first hydraulic pump being configured to be operated by the power provided from the pump drive source so as to discharge hydraulic fluid to supply the hydraulic fluid to the first main actuator;

a second hydraulic pump that is a variable displacement pump connected to a second main actuator and the attachment actuator, the second main actuator being one of the boom actuator and the arm actuator and different from the first main actuator, the second hydraulic pump being configured to be operated by the power provided from the pump drive source so as to discharge hydraulic fluid to supply the hydraulic fluid to the second main actuator and the attachment actuator;

a first main control valve interposed between the first hydraulic pump and the first main actuator, the first main control valve being operable to change a flow rate of hydraulic fluid supplied from the first hydraulic pump to the first main actuator;

a second main control valve interposed between the second hydraulic pump and the second main actuator, the second main control valve being operable to change a flow rate of hydraulic fluid supplied from the second hydraulic pump to the second main actuator;

an attachment control valve interposed between the second hydraulic pump and the attachment actuator, the attachment control valve being operable to change a flow rate of hydraulic fluid supplied from the second hydraulic pump to the attachment actuator;

a first main operation device configured to receive a first main operation for moving the first main actuator and to operate the first main control valve in accordance with the first main operation;

a second main operation device configured to receive a second main operation for moving the second main actuator and to operate the second main control valve in accordance with the second main operation;

an attachment operation device configured to receive an attachment operation for moving the attachment actuator and to operate the attachment control valve in accordance with the attachment operation;

a first merging selector valve provided between the first hydraulic pump and the second main actuator, the first merging selector valve being configured to be opened, on condition that the second main operation for operating the second main actuator at least in a raising direction is applied to the second main operation device, to allow hydraulic fluid discharged from the first hydraulic pump to merge with hydraulic fluid discharged from the second hydraulic pump to be supplied to the second main actuator; and a power distribution control device configured to operate first pump displacement that is displacement of the first hydraulic pump and second pump displacement that is displacement of the second hydraulic pump to thereby control distribution of the power provided from the pump power source to the first hydraulic pump and the second hydraulic pump; wherein:

the power distribution control device is configured to operate the first pump displacement and the second pump displacement so as to make the distribution of the power from the pump drive source to the second hydraulic pump be smaller and to make the distribution of the power from the pump drive source to the first hydraulic pump be larger when a specified combined operational action is performed on the second main operation device and the attachment operation device than when a second main single operational action is performed on the second main operation device;

the specified combined operational action is an action of applying the second main operation for operating the second main actuator in the raising direction to the second main operation device to thereby open the first merging selector valve while simultaneously applying the attachment operation to the attachment operation device;

the second main single operational action is an action of applying the second main operation to the second main operation device while not applying the attachment operation to the attachment operation device;

the power distribution control device includes: a flow rate ratio calculation section configured to calculate a flow rate ratio, based on the first main operation, the second main operation, and the attachment operation, the flow rate ratio being a ratio between a first main flow rate that is a flow rate of hydraulic fluid to be supplied from the first hydraulic pump to the first main actuator, a second main flow rate that is a flow rate of hydraulic fluid to be supplied from the second hydraulic pump to the second main actuator, an attachment flow rate that is a flow rate of hydraulic fluid to be supplied from the second hydraulic pump to the attachment actuator, and a first merging flow rate that is a flow rate of hydraulic fluid to be supplied from the first hydraulic pump to the second main actuator through the first merging selector valve; a power distribution calculation section configured to calculate a power distribution of the first hydraulic pump and the second hydraulic pump based on the flow rate ratio calculated by the flow rate ratio calculation section, the power distribution being the distribution of respective powers to be provided to the first hydraulic pump and the second hydraulic pump; and a pump displacement operation section configured to operate the first pump displacement and the second pump displacement so as to obtain the calculated power distribution, and the flow rate ratio calculation section is configured to reduce a ratio of the attachment flow rate in accordance with the second main operation applied to the second main operation device in the specified combined operational action.

2. The hydraulic driving apparatus according to claim 1, wherein the flow rate ratio calculation section is configured to reduce a ratio of the second main flow rate in accordance with the attachment operation applied to the attachment operation device in the specified combined operational action.

3. The hydraulic driving apparatus according to claim 1, further comprising a second merging selector valve provided between the second hydraulic pump and the first main actuator, the second merging selector valve being configured to be opened, on condition that the first main operation at least with respect to a raising direction is applied to the first main operation device, to allow the hydraulic fluid discharged from the second hydraulic pump to merge with the hydraulic fluid discharged from the first hydraulic pump and to be supplied to the first main actuator, wherein the flow rate ratio calculation section is also configured to calculate another flow rate ratio that is a ratio between the first main flow rate, the second main flow rate, the attachment flow rate, the first merging flow rate, and a second merging flow rate that is a flow rate of hydraulic fluid to be supplied from the second hydraulic pump to the first main actuator through the second merging selector valve, and to reduce a ratio of the second merging flow rate in accordance with the attachment operation applied to the attachment operation device when the specified combined operational action is performed.

4. The hydraulic driving apparatus according to claim 1, further comprising: a reduction degree storage section configured to store the flow rate ratio reduction degree and to designate the flow rate ratio reduction degree to the flow rate ratio calculation section; and a change command input section configured to input a command for changing the flow rate ratio reduction degree into the reduction degree storage section, the reduction degree storage section being configured to change the flow rate ratio reduction degree based on the change command that is input from the change command input section.

5. The hydraulic driving apparatus according to claim 4, wherein the change command input section is configured to receive a reduction degree change operation for changing the flow rate ratio reduction degree and to input a direct change command corresponding to the reduction degree change operation into the reduction degree storage section.

6. The hydraulic driving apparatus according to claim 4, wherein: the reduction degree storage section is configured to store a plurality of flow rate ratio reduction degrees corresponding to a plurality of working modes, respectively, as the flow rate ratio reduction degree; the change command input section is configured to input a mode specifying command for specifying a predetermined working mode from the plurality of working modes into the reduction degree storage section as the change command; and the reduction degree storage section is configured to select the flow rate ratio reduction degree corresponding to the working mode specified by the mode specifying command from the plurality of working modes and to designate the flow rate ratio reduction degree to the flow rate ratio calculation section.

7. The hydraulic driving apparatus according to claim 6, wherein the change command input section is configured to receive the reduction degree change operation and to input the direct change command corresponding to the reduction degree change operation into the reduction degree storage section, and the reduction degree storage section is configured to store a plurality of change allowable ranges corresponding to the plurality of working modes, respectively, and to allow the flow rate ratio reduction degree to be changed only within the change allowable range corresponding to the designated working mode.

* * * * *